US005827094A

United States Patent [19]

Aizawa et al.

[11] Patent Number: 5,827,094

[45] Date of Patent: Oct. 27, 1998

[54] CONNECTOR FOR HEAVY CURRENT SUBSTRATE

[75] Inventors: Eiichi Aizawa; Shinobu Saito, both of Tsuru, Japan

[73] Assignee: Aikawa Press Industry Co., Ltd., Japan

[21] Appl. No.: 858,495

[22] Filed: May 19, 1997

[51] Int. Cl.[6] ..... H01R 9/09

[52] U.S. Cl. ..... 439/857; 439/947

[58] Field of Search ..... 439/78, 81, 83, 439/82, 855, 856, 857, 947, 947.2

[56] References Cited

U.S. PATENT DOCUMENTS

| | | | |
|---|---|---|---|
| 4,387,950 | 6/1983 | Guzik et al. | 439/855 |
| 5,007,844 | 4/1991 | Mason et al. | 439/83 |

*Primary Examiner*—Neil Abrams
*Assistant Examiner*—Barry M. L. Standig
*Attorney, Agent, or Firm*—McDonnell Boehnen Hulbert & Berghoff

[57] ABSTRACT

A connector for a heavy current substrate in which a power source wire for passing the heavy current is connected to a substrate comprises a male terminal which is flexibly formed by a pair of side walls to be directly attached to the substrate and a base wall so that the section thereof may be generally U-shaped, a female terminal which is flexibly formed so as to be integrated with a pair of elastic side walls for holding the male terminal therebetween and a base wall in which a connecting portion to be connected to the power source wire is extended, and an insulating cover which is flexibly formed so as to be integrated with a pair of elastic side walls for covering and holding the female terminal therebetween and a base wall. The power source wire can be easily connected to the substrate. Furthermore, an outer surface of the side wall of the male terminal is in a surficial contact with an inner surface of the elastic side wall of the female terminal, so that a contact area of the terminals can be sufficiently ensured.

10 Claims, 14 Drawing Sheets

CONNECTOR FOR HEAVY CURRENT SUBSTRATE

BACKGROUND OF THE INVENTION

1. Field of the Invention

The present invention relates to a connector for a heavy current substrate in which a power source wire for passing the heavy current is connected to a substrate.

2. Description of the Prior Art

In case of an industrial machine, in general, in the first place, the power source wire from a commercial power source, a power source circuit, etc. is connected to a terminal board. Next, a necessary number of the power source wire is drawn out from the terminal board, and the terminal of the power source wire is connected to each control circuit of the substrate by soldering, so that the current for controlling is supplied. A plurality of detent-type terminal portions are formed on the terminal board. The terminal of the power source wire is detent-locked with each terminal portion so that a plurality of power source wires can be drawn out.

However, according to a connecting structure of the power source wire as described above, when the substrate is removed from a control portion, the detent on the terminal board must be unfastened in order to remove the power source wire from the terminal board or a soldered portion must be re-melted in order to remove the power source wire from the terminal board. Accordingly, more specifically, when many power source wires are used, etc., it takes much time and labor to remove the power source wire.

Furthermore, when the substrate is connected to the power source wire, since the terminal board is absolutely necessary, a space for mounting the terminal board in the control portion and a mounting work are necessary. As a result, a manufacturing cost is increased.

Accordingly, the connector for the substrate in which the power source wire can be directly attached to the substrate is proposed (as disclosed in Japanese Patent Application Laid-open No. 59-47865, etc.). As shown in FIG. 1, a connector for the substrate 1 comprises a casing 7 provided with a contact groove 5 which a circuit plate edge portion 3 is inserted into and is fitted with, and a terminal 11 being contact means accommodated in reception spaces 9 formed at both sides of the contact groove 5. The terminal 11 comprises a support rod 13 fixed in the reception space 9 and a plate spring 15 which is arc-locked with the support rod 13. The circuit plate edge portion 3 is inserted between the terminals 11 accommodated in the reception spaces 9 at both the sides of the contact groove 5. Thereby, the circuit plate edge portion 3 is elastically held between the plate springs 15 opposite each other. The circuit plate edge portion 3 is electrically connected to the terminal 11, so that the power source wire can be directly connected to the substrate.

However, according to the connector for the substrate 1, since the circuit plate edge portion 3 is not in a surficial contact with the plate springs 15, a contact area is small. Accordingly, although the connector is used for a light current, the connector is not suitable to a connection for the heavy current (for example, 100 A).

Thus, in order to increase the contact area of the plate springs 15, the plate springs 15 is brought into a surficial contact with the circuit plate edge portion 3. In this case, when the circuit plate edge portion 3 is inserted into the contact groove 5, a frictional force is increased, whereby an inserting force is increased. Accordingly, a workability for connecting the circuit plate edge portion 3 to the plate springs 15 becomes worse.

SUMMARY OF THE INVENTION

It is an object of the present invention to provide a connector for a heavy current substrate in which terminals can ensure a contact area which can allow the heavy current to pass through, and further in which a power source wire can be easily connected to a substrate.

In order to achieve the above object, according to one aspect of the present invention, there is provided a connector for a heavy current substrate in which a power source wire for passing the heavy current is connected to a substrate which comprises a male terminal which is flexibly formed by a pair of side walls to be directly attached to the substrate and a base wall so that the section thereof may be generally U-shaped, and a female terminal which is flexibly formed so as to be integrated with a pair of elastic side walls for holding the male terminal therebetween and a base wall in which a connecting portion to be connected to the power source wire is extended.

According to the present invention, both the side walls of the male terminal to be directly attached to the substrate is held between both the elastic side walls of the female terminal to be connected to the power source wire. Thereby, the power source wire can be easily connected to the substrate. Furthermore, since an outer surface of the side wall of the male terminal is in a surficial contact with an inner surface of the elastic side wall of the female terminal, the contact area of the terminals can be sufficiently ensured. Furthermore, since the side walls of the male terminal are elastically held between the elastic side wall of the female terminal, even if a foreign body is intervened between the terminals, the female terminal is always in contact with the male terminal.

According to another aspect of the present invention, there is provided a connector for a heavy current substrate which further comprises an insulating cover which is flexibly formed so as to be integrated with a pair of elastic side walls for holding the female terminal therebetween and a base wall.

According to the present invention, the female terminal is held between the insulating cover which is flexibly formed so as to be integrated with a pair of elastic side walls and the base wall, whereby a safety of the terminals can be ensured. Furthermore, the elastic side walls of the female terminal for holding the male terminal therebetween is further elastically held between the elastic side walls of the cover, so that a holding force of the female terminal for holding the male terminal can be enhanced.

According to further aspect of the present invention, there is provided a connector for a heavy current substrate wherein the male terminal has a reinforcement plate protruded parallel to the substrate and overlapped on the substrate at the side wall thereof.

According to the present invention, the reinforcement plate protruded parallel to the substrate and overlapped on the substrate is protruded on the side wall of the male terminal, whereby a strength relative to a load applied in a width direction of the male terminal can be enhanced.

According to further aspect of the present invention, there is provided a connector for a heavy current substrate wherein a detachment stopping protrusions are protruded on each side wall of the male terminal, detachment stoppers to be locked with the detachment stopping protrusions are formed on each elastic side wall of the female terminal, and detachment stopping holes to be locked with the detachment stoppers are bored through each elastic side wall of the cover.

According to the present invention, when the female terminal is fitted with the cover, a positioning can be carried out. Furthermore, the detachment stopping holes bored through each elastic side wall of the female terminal and the cover are locked with one another so as to prevent the female terminal and the cover from detaching.

According to further aspect of the present invention, there is provided a connector for a heavy current substrate wherein the female terminal is integrally formed by a stainless.

According to the present invention, the female terminal is integrally formed by the stainless, whereby the male terminal can be held at an appropriate contact pressure.

According to further aspect of the present invention, there is provided a connector for a heavy current substrate wherein the connecting portion is inserted into and fitted with a hollow hole of a cylindrical sleep terminal connected to the terminal of the power source wire, so that the female terminal is connected to the power source wire.

According to the present invention, the connecting portion is inserted into and fitted with the hollow hole of the cylindrical sleep terminal connected to the terminal of the power source wire so that the female terminal may be connected to the power source wire. Thereby, the terminal of the power source wire can be easily connected to the female terminal.

The nature, principle and utility of the invention will become more apparent from the following detailed description when read in conjunction with the accompanying drawings.

DESCRIPTION OF THE PREFERRED EMBODIMENTS

Embodiments of the present invention will be described in detail with reference to the accompanying drawings.

Embodiment 1

FIGS. 2 to 9 show a connector for a heavy current substrate according to a first embodiment of the present invention.

Figure 1:
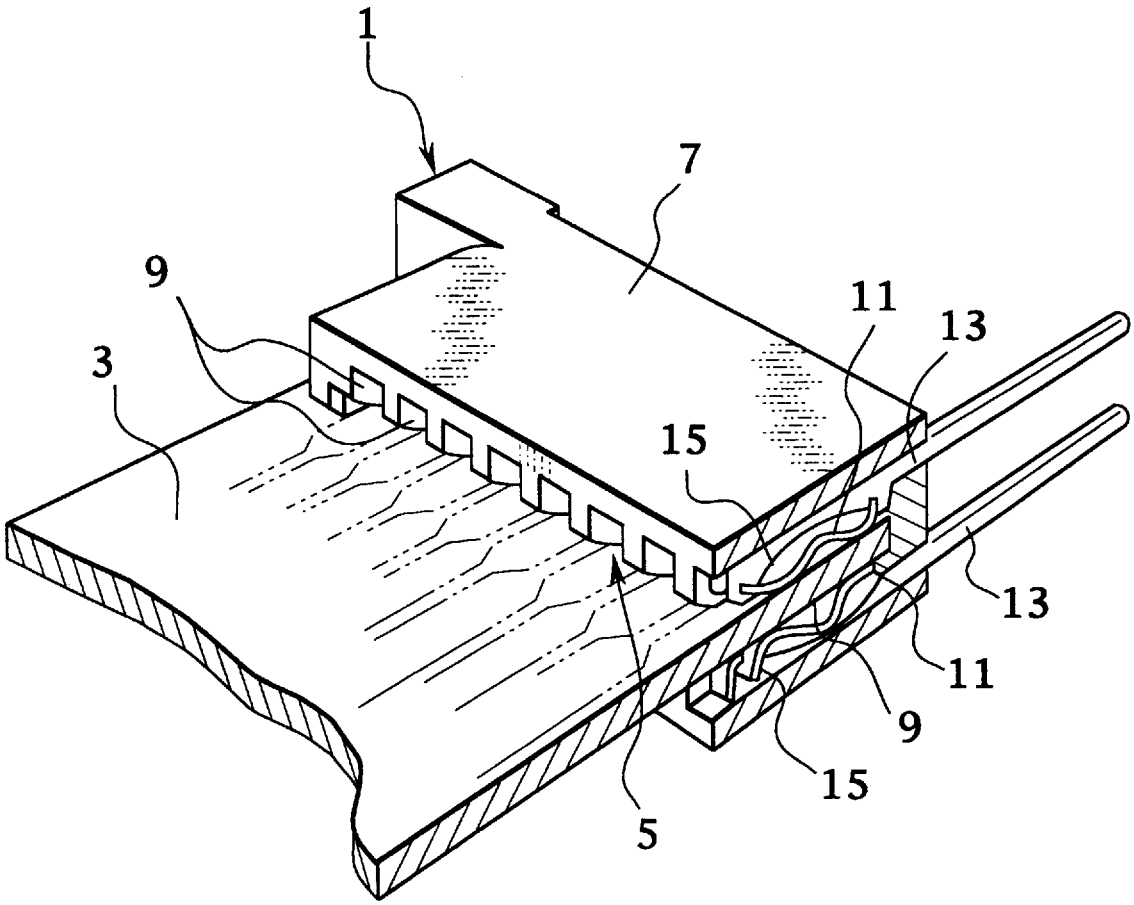
FIG. 1 PRIOR ART
FIG. 1 shows a perspective view of a conventional connector for a substrate.
Figure 2:
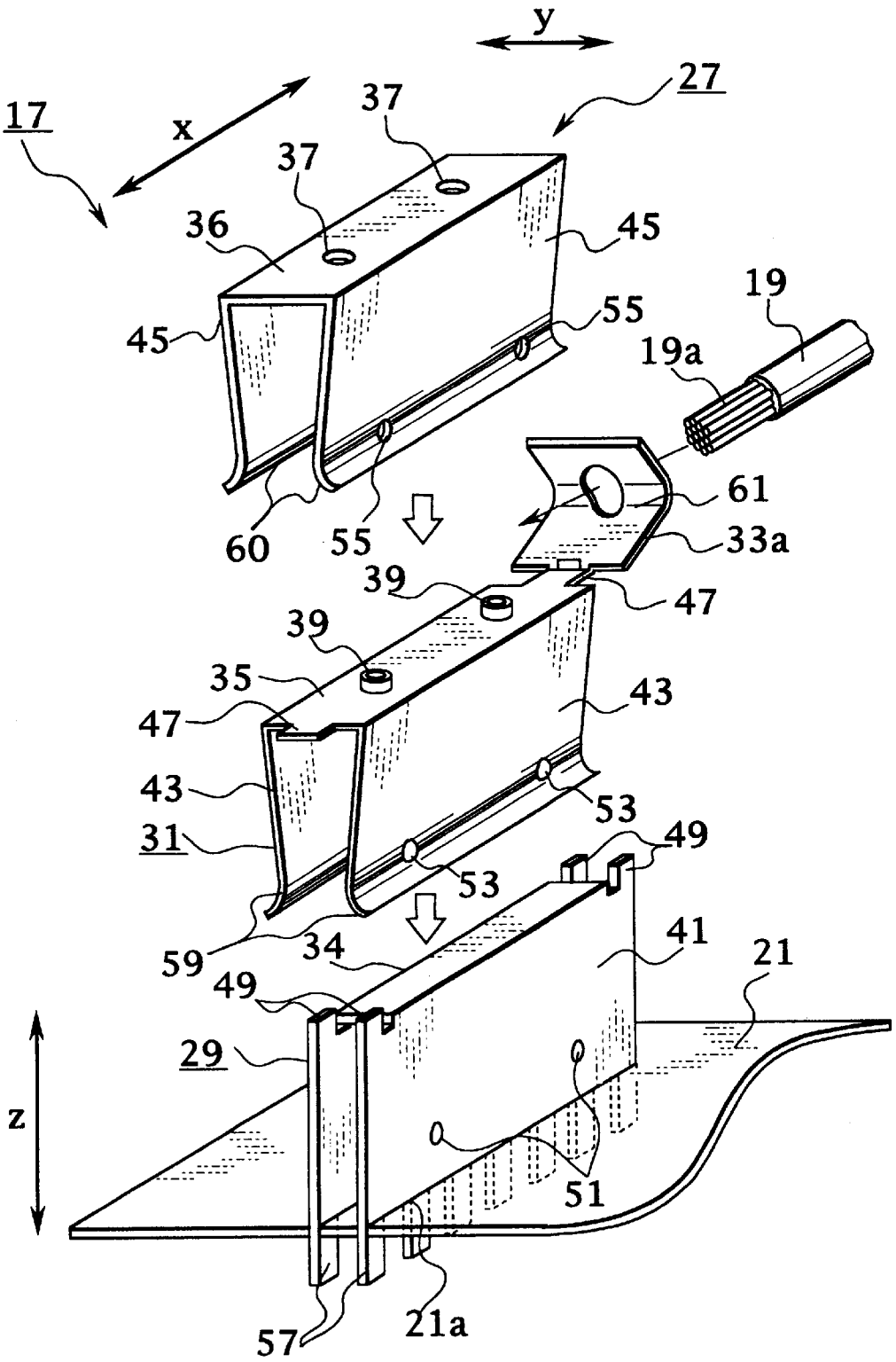
FIG. 2 shows an exploded perspective view of the connector for the substrate according to a first embodiment of the present invention.
Figure 3:
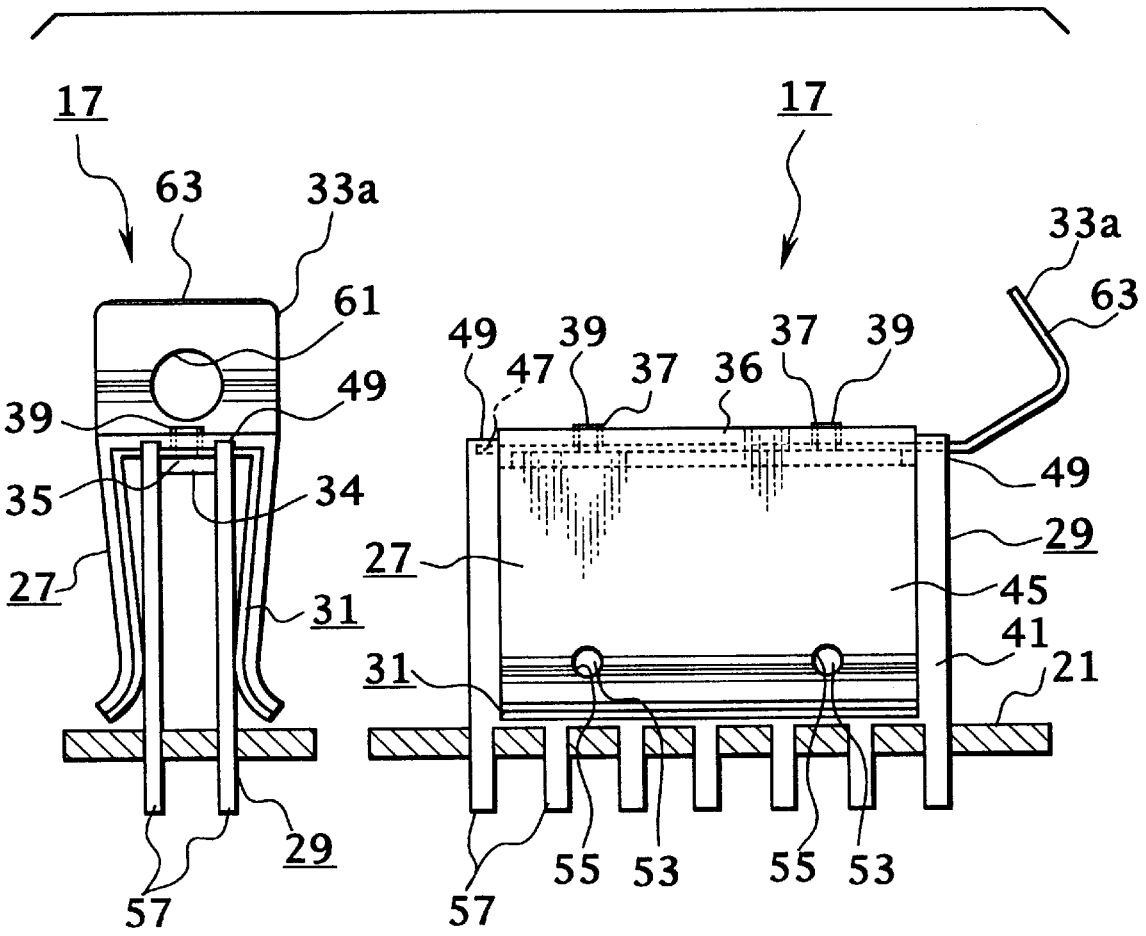
FIG. 3 shows a front view and a side view of a fitted state of a male terminal, a female terminal and a cover according to the first embodiment of the present invention.

As shown in FIG. 2 or 3, the connector for the heavy current substrate 17 comprises a female terminal 31 to be connected to a terminal 19*a* of a power source wire 19, a male terminal 29 to be fitted with the female terminal 31 and to be directly attached to a substrate 21, and a cover 27 fitted with the female terminal 31 for covering the terminals 29, 31. In FIG. 2, an x direction shows a longitudinal direction of the connector for the heavy current substrate, a y direction shows a width direction thereof, and a z direction shows a fitting direction, respectively.

Figure 4:
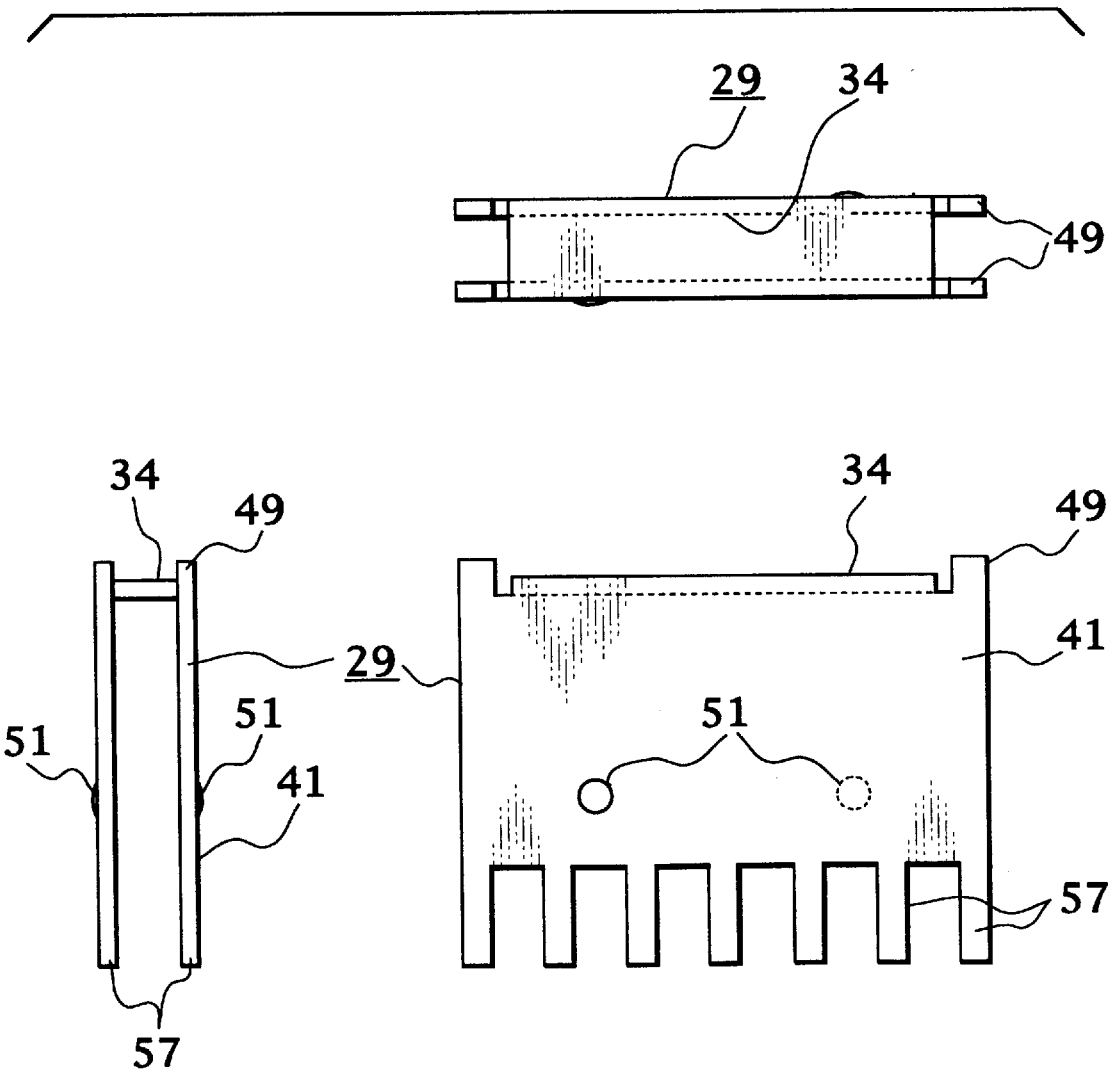
FIG. 4 shows a front view, a side view and a top view of the male terminal according to the first embodiment of the present invention.

As shown in FIG. 4, the male terminal 29 comprises a base wall 34 and a pair of side walls 41, 41 connected to the base wall 34 so that the section thereof is generally U-shaped. Furthermore, seven further finer leg terminals 57 are protruded downward at an edge of each side wall 41. The leg terminals 57 are directly attached perpendicularly to leg holes 21*a* (see FIG. 2) bored on the substrate 21. The number of the leg terminals 57 and the leg holes 21*a* is changed, and the leg terminals 57 can be also directly attached to the substrate 21.

The male terminal 29 is integrally formed by using a conductive material, for example, a stainless.

Figure 5:
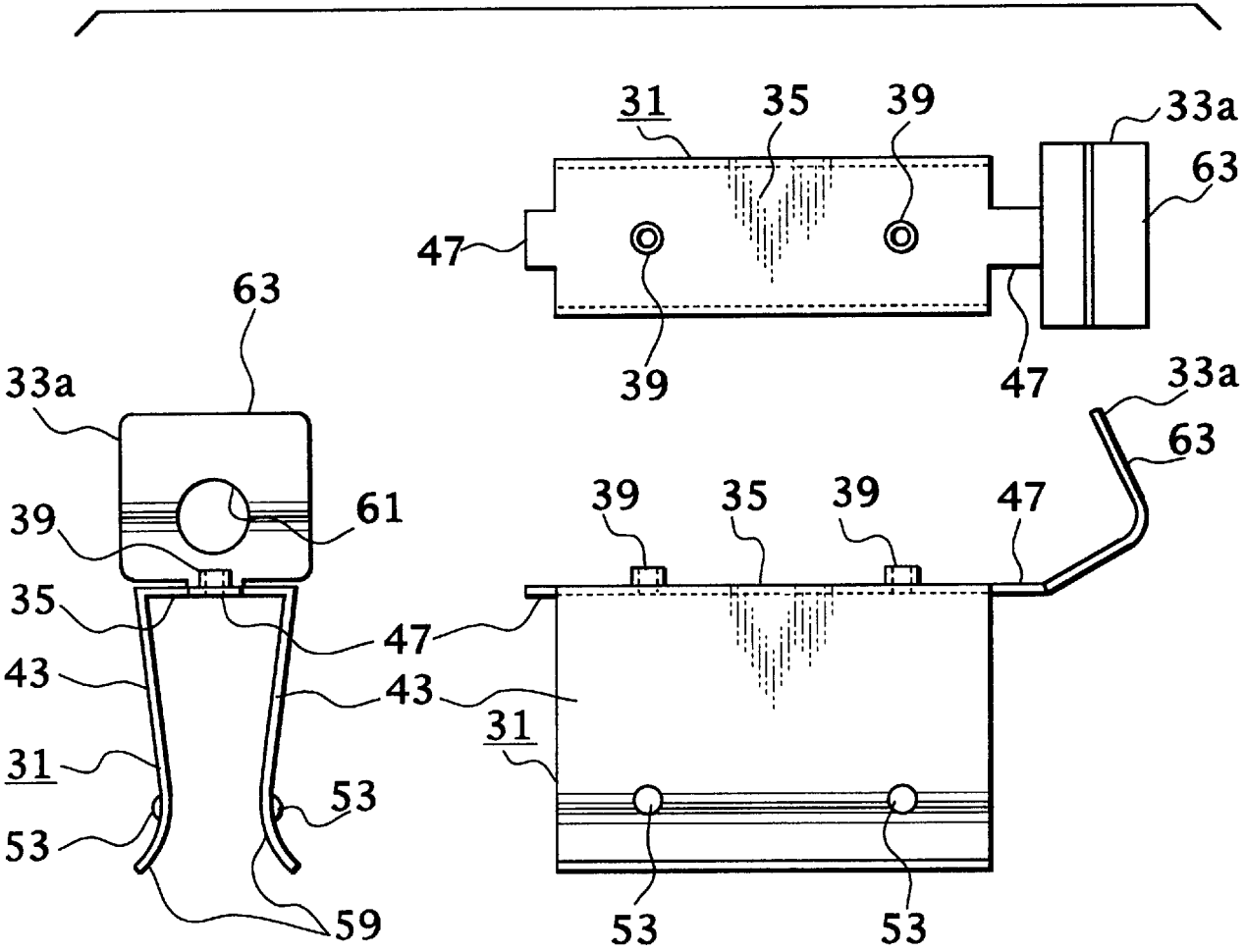
FIG. 5 shows a front view, a side view and a top view of the female terminal according to the first embodiment of the present invention.

As shown in FIG. 5, the female terminal 31 comprises a pair of elastic side walls 43, 43, one ends thereof connected to a base wall 35 and the other ends thereof located close to each other, and a connecting portion 33 extended in the x direction from the base wall 35 so as to be connected to the terminal 19*a* of the power source wire 19. The female terminal 31 is integrally formed by using the conductive material, for example, the stainless, a copper, etc.

An Introduction portion 59 which is gently curved outward at generally 45° at an edge side of each elastic side wall 43 so that the female terminal 31 may be easily inserted into the male terminal 29. Furthermore, detachment stoppers 53, 53 are formed at two positions near the introduction portion 59 by spherically soldering. The detachment stoppers 53, 53 are locked with detachment stopping protrusions 51, 51 formed on each side wall 41 of the male terminal 29 by spherically soldering so as to prevent the female terminal 31 from detaching.

Locking portions 47, 47 are extended to outer peripheral end portions of the base wall 35 opposite to each other, respectively. The locking portions 47, 47 are locked with lock receiving portions 49, 49 protruded outward in the z direction at both ends of each side wall 41 of the male terminal 29 so that the female terminal 29 may be positioning fixed to the male terminal 29.

The power source wire 19 is connected to the connecting portion 33 by caulking. The connecting portion 33 is shown in, for example, FIGS. 5 to 8.

A connecting portion 33*a* shown in FIG. 5 is so formed that a caulking plate 63 having an inserting hole 61 for inserting the terminal 19*a* of the power source wire 19 at the center portion thereof is perpendicularly flexed. The power source wire 19 is inserted into the inserting hole 61, and the caulking plate 63 which is curved so that the section thereof may be generally V-shaped is folded, whereby the power source wire 19 is caulking connected to the connecting portion 33*a*.

Figure 6:
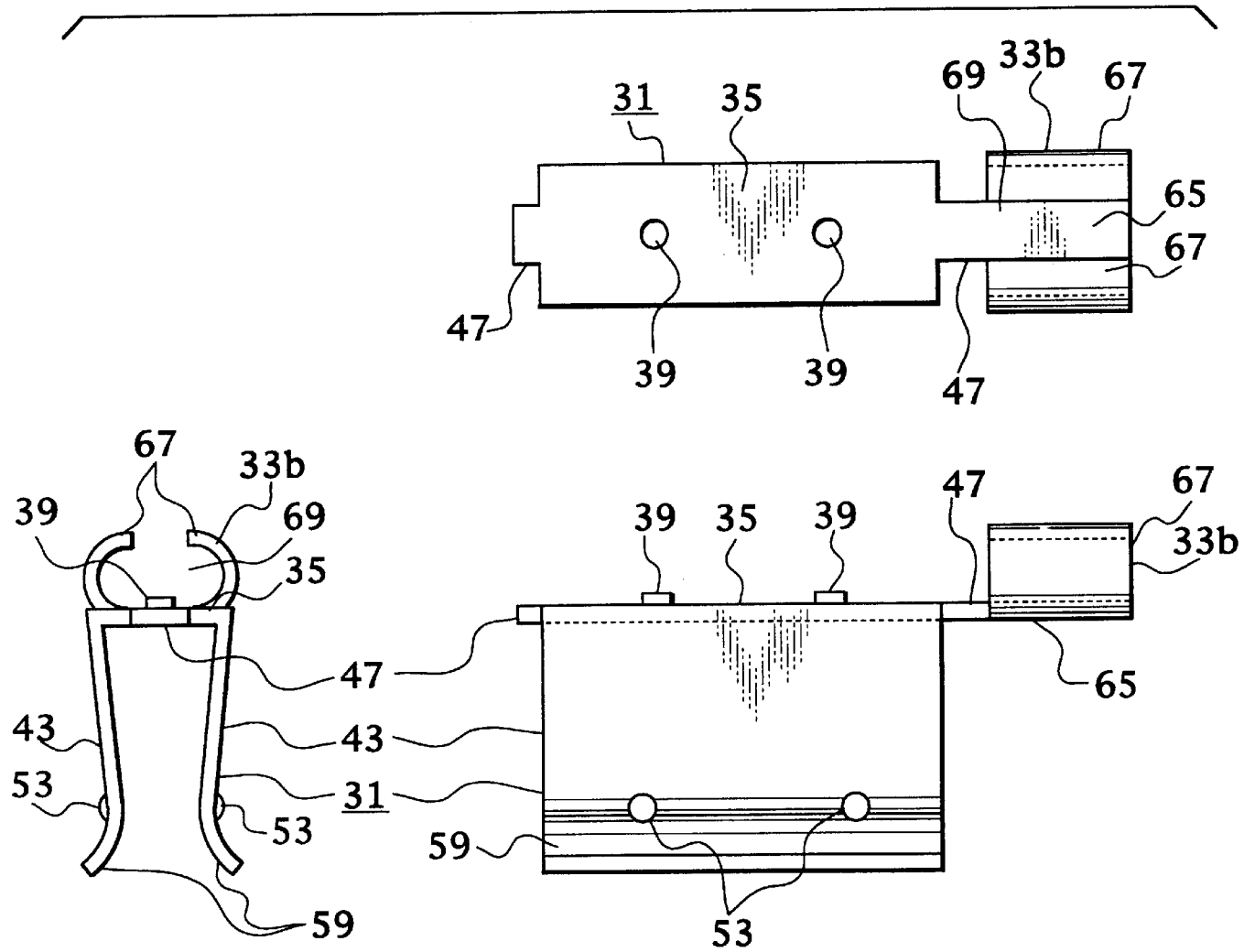
FIG. 6 shows a front view, a side view and a top view of another female terminal according to the first embodiment of the present invention.
Figure 7:
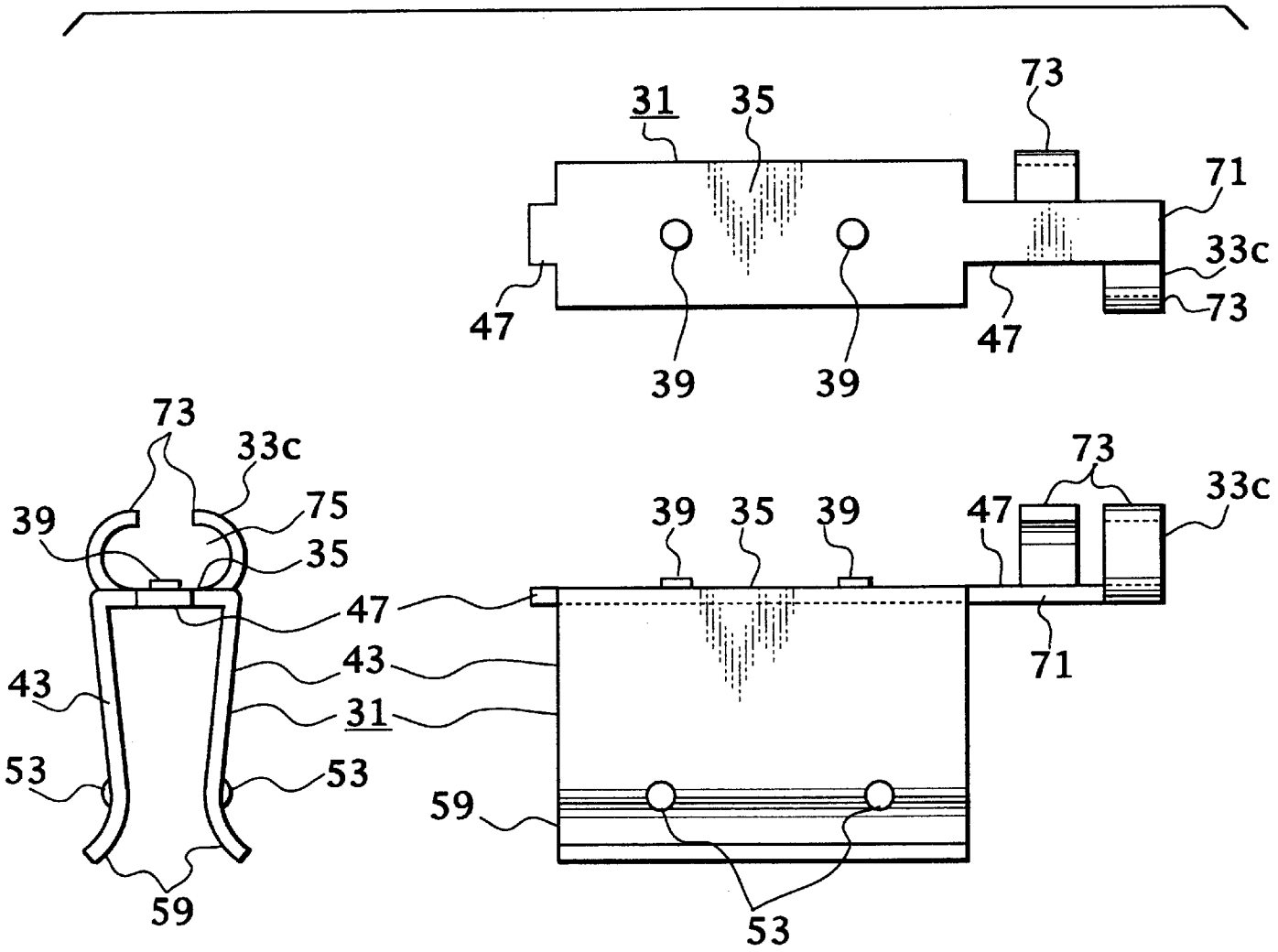
FIG. 7 shows a front view, a side view and a top view of further female terminal according to the first embodiment of the present invention.

A connecting portion 33*b* shown in FIG. 6 is provided with two curved elastic caulking plates 67, 67 which are oppositely located at sides opposite to each other of a caulk receiving portion 65 extended to the locking portion 47. The terminal 19*a* of the power source wire 19 is inserted into an inserting portion 69 surrounded by the caulk receiving portion 65 and the elastic caulking plates 67, 67, whereby the elastic caulking plates 67, 67 are caulking connected to the terminal 19*a* of the power source wire 19.

A connecting portion 33*c* shown in FIG .7 is provided with two curved elastic caulking plates 73, 73 which are shifted to each other in the x direction (longitudinal direction) at the sides opposite to each other of a caulk receiving portion 71 extended to the locking portion 47. The terminal 19*a* of the power source wire 19 is inserted into an inserting portion 75 surrounded by the caulk receiving portion 71 and the elastic caulking plates 73, 73, whereby the elastic caulking plates 73, 73 are caulking connected to the terminal 19*a* of the power source wire 19.

Figure 8:
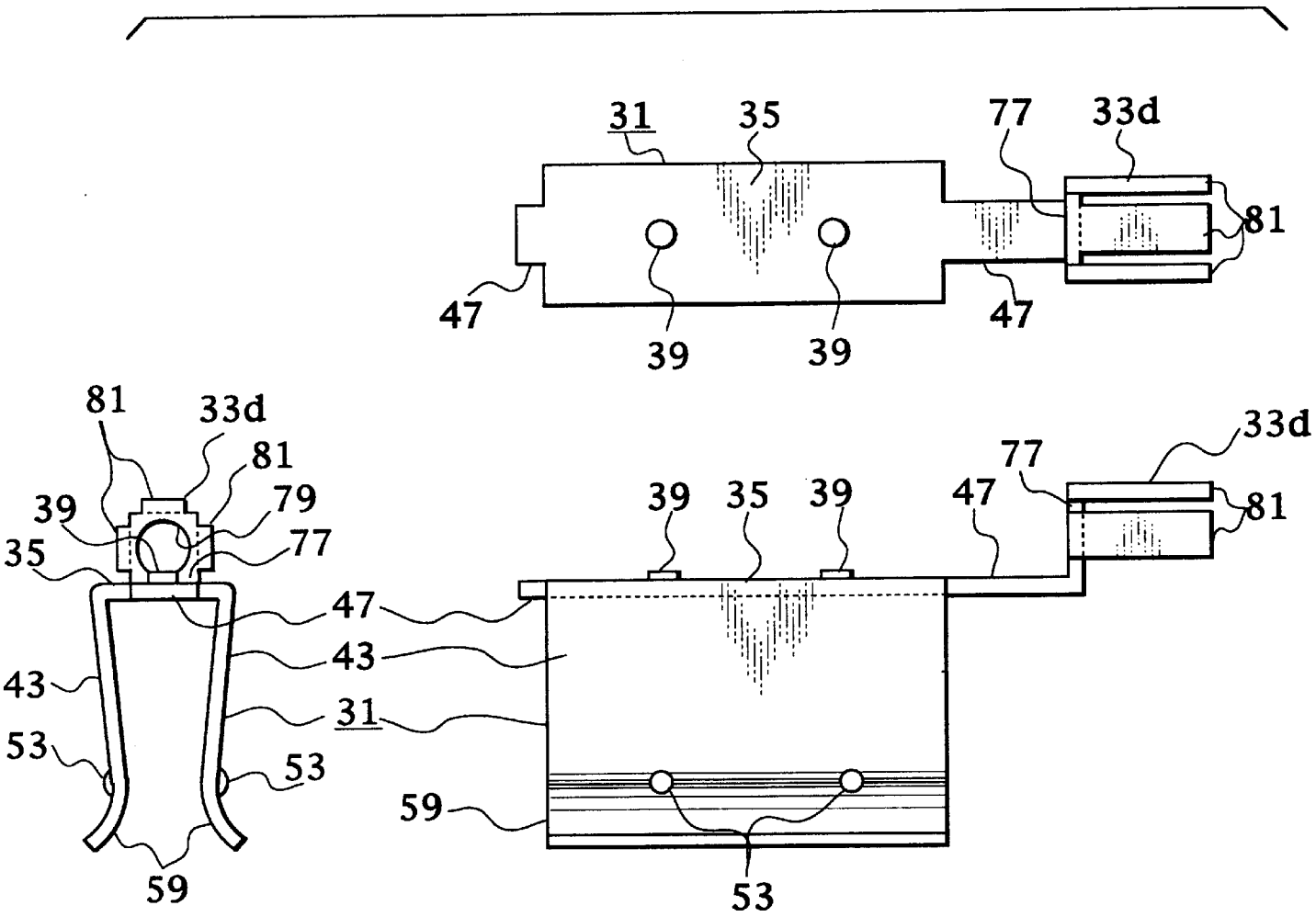
FIG. 8 shows a front view, a side view and a top view of further female terminal according to the first embodiment of the present invention.

A connecting portion 33*d* shown in FIG. 8 is so disposed that a caulking plate 77 having an inserting hole 79 for the terminal 19*a* of the power source wire 19 is located perpendicularly to the locking portion 47. The caulking plate 77 is provided with three caulking flaps 81, 81, 81 perpendicular to the caulking plate 77. The terminal 19*a* of the power source wire 19 is inserted into the inserting hole 79, whereby the caulking flaps 81, 81, 81 are caulking connected to the terminal 19*a* of the power source wire 19.

According to a type of the power source wire 19, a shape of the connecting portion 33 of the female terminal 31 may be appropriately selected.

Figure 9:
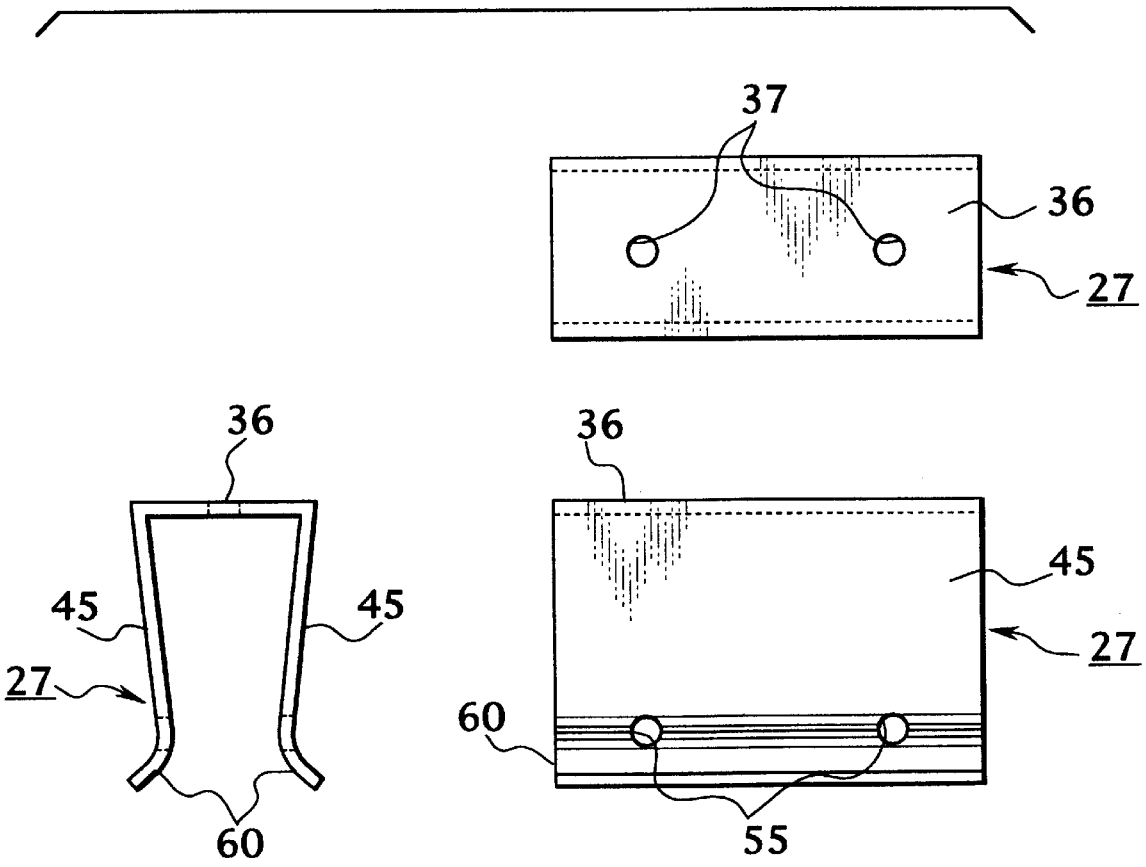
FIG. 9 shows a front view, a side view and a top view of the cover according to the first embodiment of the present invention.

On one hand, as shown in FIG. 9, the cover 27 comprises a base wall 36 and a pair of elastic side walls 45, 45, one ends thereof connected to the base wall 36 and the other ends thereof located close to each other. The cover 27 is integrally formed by a resin.

An introduction portion 60 which is gently curved outward at 45° is formed at the edge portion of each elastic side wall 45 so that the cover 27 may be easily inserted into the female terminal 31. Furthermore, detachment stopping holes 55, 55 are bored at two positions near the introduction portion 60. The detachment stopping holes 55, 55 are locked with the detachment stoppers 53, 53 of the female terminal 31 so as to prevent the cover 27 from detaching.

Fitting holes 37, 37 to be fitted with columnar fitting portions 39, 39 protruded on the base wall 35 of the female terminal 31 are bored through the base wall 36 so that the cover 27 may be fixed to the female terminal 31.

The cover 27 is fitted with the male terminal 29 connected to the substrate 21 via the female terminal 31 communicated with the connecting portion 33 connected to the terminal 19*a* of the power source wire 19. As a result, the side walls 41, 41 of the mate terminal 29 are elastically held between the elastic side walls 43, 43 of the female terminal 31. The elastic side walls 43, 43 of the female terminal 31 is elastically held between the elastic side walls 45, 45 of the cover 27.

In such a manner, according to the connector for the heavy current substrate 17 of the present invention, the side walls 41, 41 of the mate terminal 29 which is directly attached to the substrate 21 is held between the elastic side walls 43, 43 of the female terminal 31 to be connected to the terminal 19*a* of the power source wire 19. Accordingly, the power source wire 19 can be easily connected to the substrate 21. In addition, since the terminals 29, 31 are in a surficial contact with each other, the terminals can sufficiently tolerate the heavy current of about 100 A. Accordingly, it is not necessary that the terminal 19*a* of the power source wire 19 is detent-locked with a terminal board, etc. as shown by the prior art. Furthermore, since the detent and the terminal board are also unnecessary, a man-hour can be reduced during manufacturing. Furthermore, since a plurality of circuits formed on the substrate 21 can be connected to and be disconnected from the power source wire 19 at once, a working time can be reduced.

Furthermore, the elastic side walls 43, 43 of the female terminal 31 for holding the male terminal 29 therebetween is held between the elastic side walls 45, 45 of the cover 27. Accordingly, a safety of the connector 17 can be ensured, and further a force of the female terminal 31 for holding the male terminal 29 between the side walls can be increased. When a foreign body is intervened between the terminals 29 and 31, the female terminal 31 is always in contact with the male terminal 29. As a result, a stable connecting state can be maintained.

Furthermore, the detachment stopping protrusions 51, 51 are protruded on each side wall 41 of the male terminal 29 so as to be locked with the detachment stoppers 53, 53 bored through each elastic side wall 43 of the female terminal 31 and the detachment stopping holes 55, 55 bored through each elastic side wall 45 of the cover 27. Accordingly, when the cover 27 is fitted with the female terminal 31, a positioning can be carried out, and further it is possible to prevent the female terminal 31 and the cover 27 from detaching.

As described above in detail, when the connector for the heavy current substrate 17 is used for connecting to the substrate 21, a reliability can be enhanced. For example, the connector 17 maybe applied to an NC machine, a power source unit, an inverter unit, an automotive power steering unit, etc.

When the female terminal 31 is integrally formed by using the stainless, it is known that an appropriate holding force can be obtained. When the female terminal 31 is integrally formed by using the copper, although the holding force is weakened, as described in the first embodiment, since the holding force of the female terminal 31 is increased by the cover 27, a necessary holding force can be sufficiently ensured.

Embodiment 2

FIGS. 10 to 14 show a connector for a heavy current substrate according to a second embodiment of the present invention.

Figure 10:
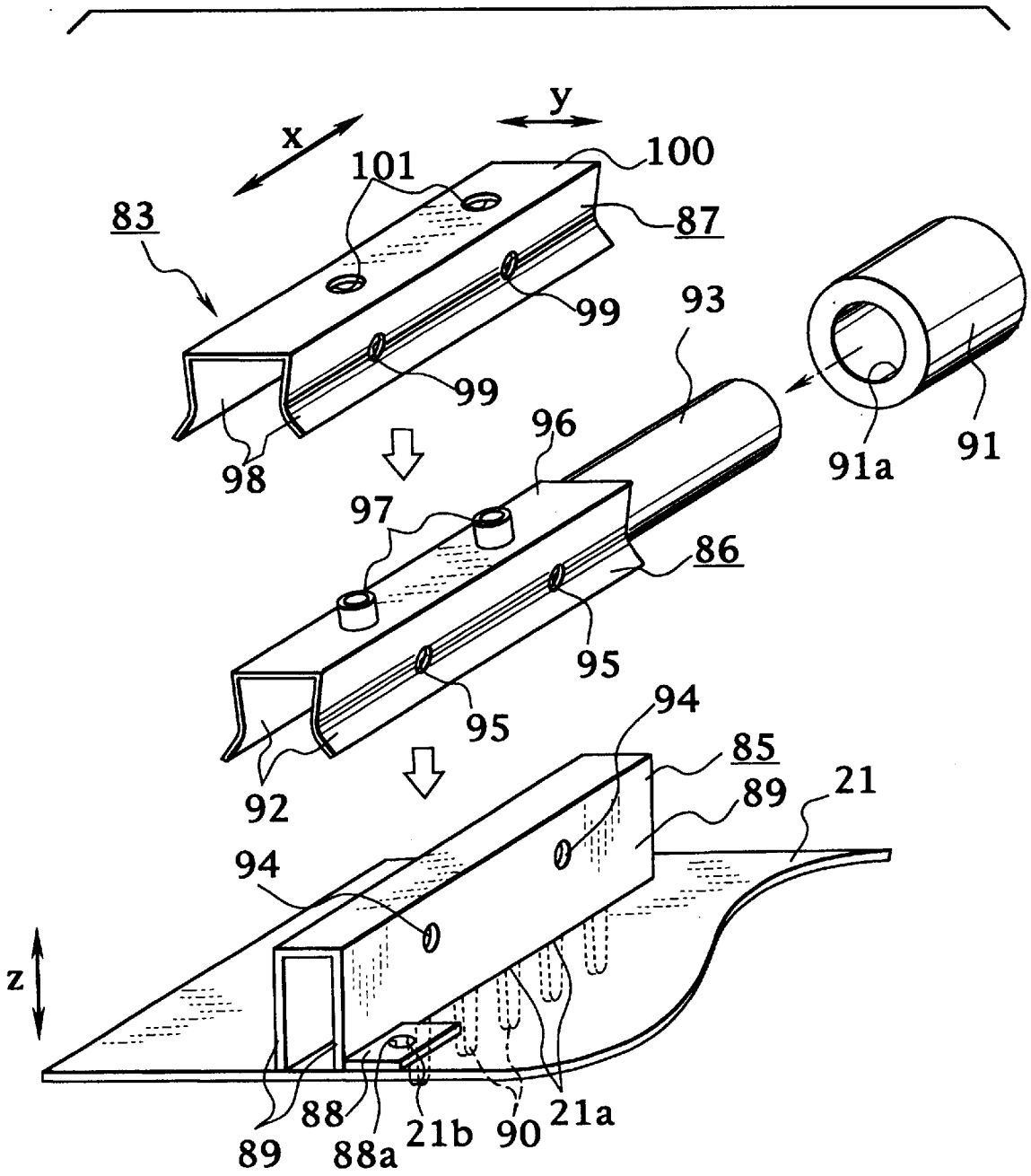
FIG. 10 shows an exploded perspective view of the connector for the substrate according to a second embodiment of the present invention.
Figure 11:
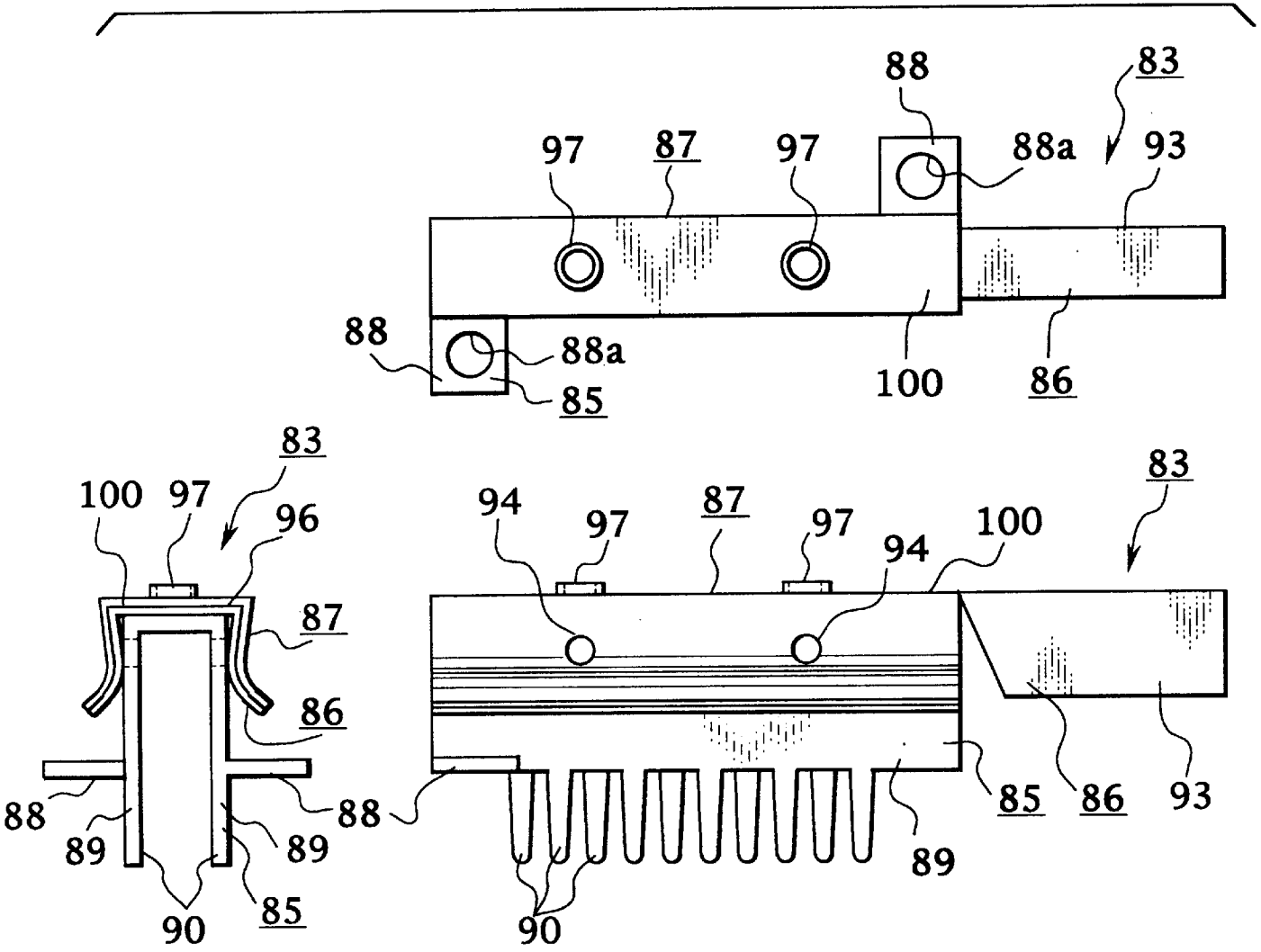
FIG. 11 shows a front view, a side view, a top view and a rear view of a fitted state of the male terminal, the female terminal and the cover according to the second embodiment of the present invention.
Figure 12:
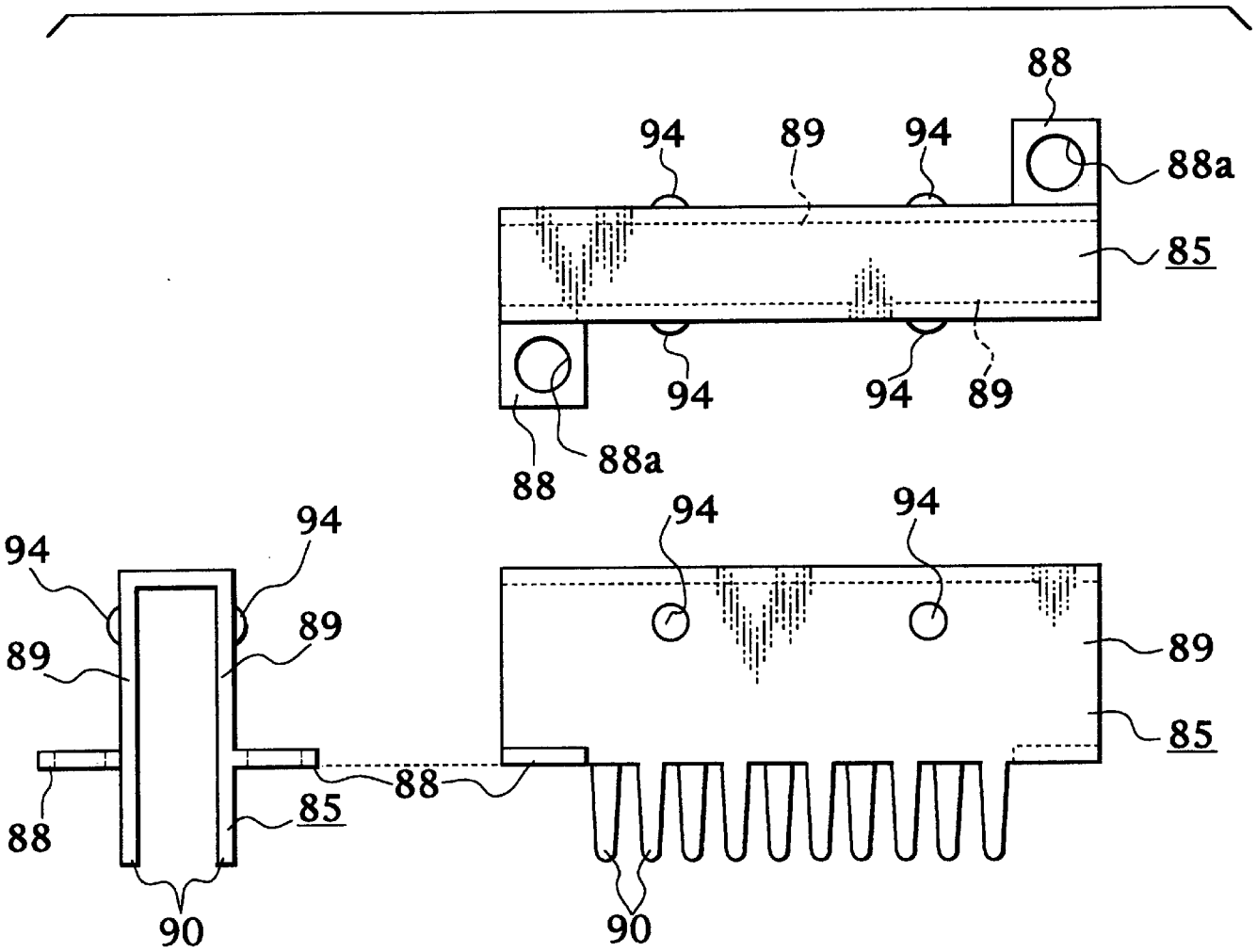
FIG. 12 shows a front view, a side view and a top view of the male terminal according to the second embodiment of the present invention.
Figure 13:
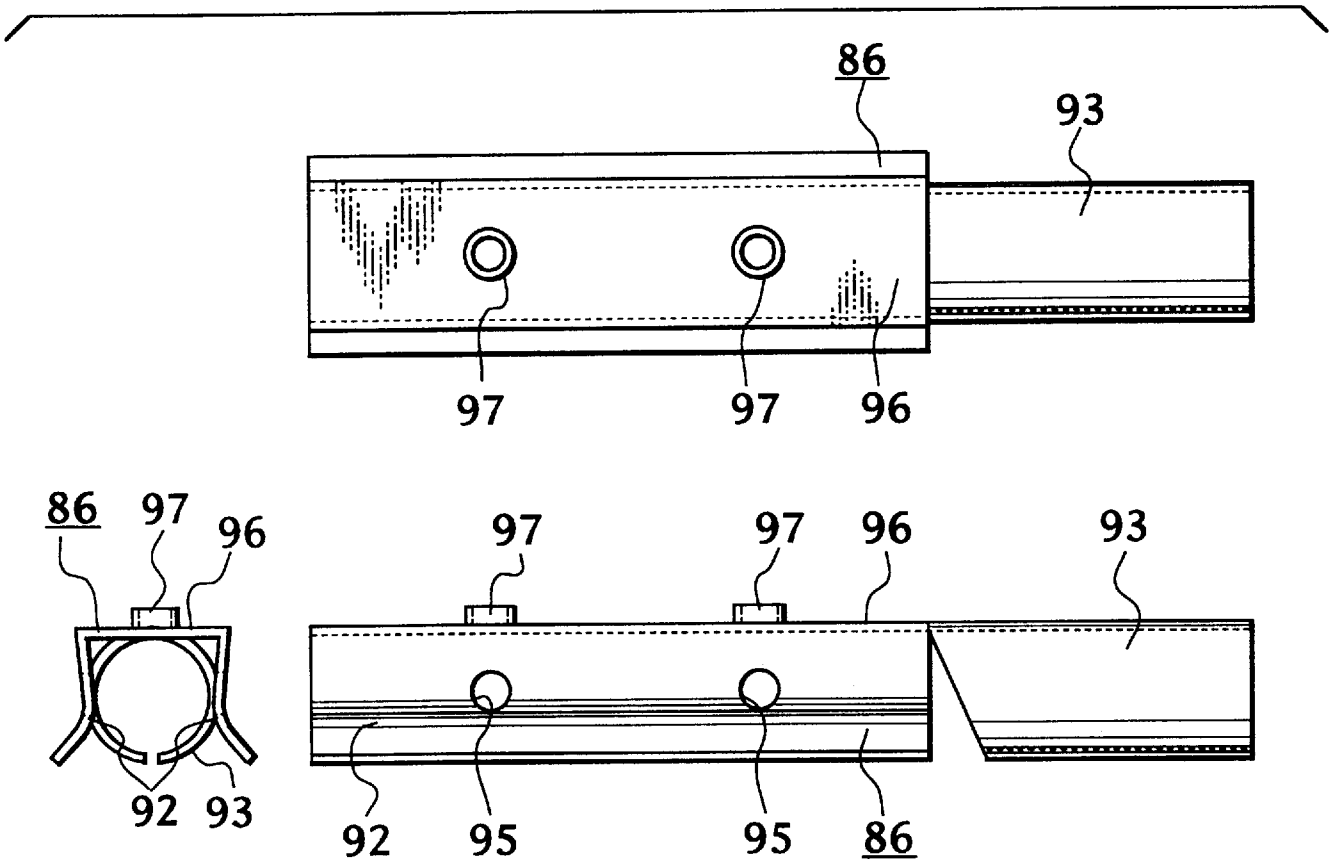
FIG. 13 shows a front view, a side view and a top view of the female terminal according to the second embodiment of the present invention.
Figure 14:
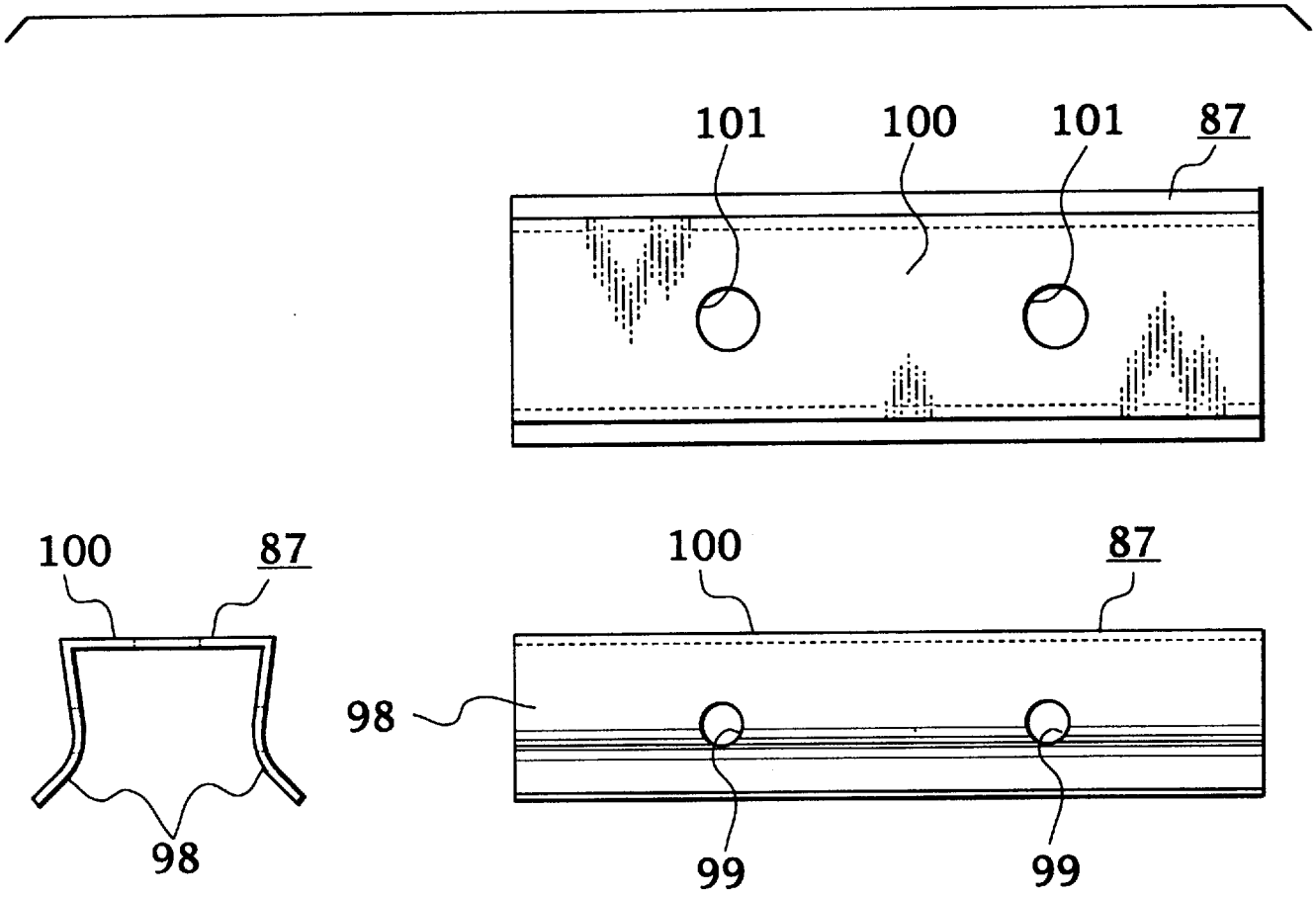
FIG. 14 shows a front view, a side view and a top view of the cover according to the second embodiment of the present invention.

As shown in FIGS. 10 and 11, a connector for a heavy current substrate 83 comprises a female terminal 86 to be connected to the terminal of the power source wire (not shown), a male terminal 85 to be fitted with the female terminal 86 and further to be directly attached to the substrate 21, and a cover 87 to be fitted with the female terminal 86 for covering the terminals 85, 86.

Similarly to the first embodiment, leg terminals 90 and detachment stopping protrusions 94 are disposed on a side wall 89 of the male terminal 85. Furthermore, a reinforcement plate 88 is extended parallel to the substrate 21 near a joint of the leg terminal 90. A fixing hole 88*a* is bored at the center portion of the reinforcement plate 88 so that a fixing protrusion 21*b* protruded on the substrate 21 can be inserted into the fixing hole 88*a* so as to be fixed. Thus, the reinforcement plate 88 overlapped on the substrate 21 is disposed, whereby a strength relative to a load applied in the y direction of the male terminal 85 can be enhanced.

Furthermore, the female terminal 86 is provided with detachment stopping holes 95 bored through an elastic side wall 92 which is formed relatively shorter than the elastic side wall 43 of the female terminal 31 according to the first embodiment. The detachment stopping hole 95 is locked with the detachment stopping protrusion 94 so as to prevent the female terminal 86 from detaching. Furthermore, fitting portions 97 are protruded upward on a base wall 96. The female terminal 86 is provided with a connecting portion 93 extended in the x direction. The connecting portion 93 of the female terminal 86 is cyrindrically formed so that it can be inserted into and be detached from an inserting hole 91*a* being a hollow portion of a cylindrical sleep terminal 91 connected to the terminal of the power source wire (not shown).

Furthermore, the cover 87 is provided with detachment stopping holes 99 bored through an elastic side wall 98 which is formed relatively shorter than the elastic side wall 45 of the cover 27 according to the first embodiment similarly to the female terminal 86. The detachment stopping hole 99 is locked with the detachment stopping hole 95 so as to prevent the cover 87 from detaching. Furthermore, fitting holes 101 are bored through a base wall 100, so that the fitting hole 101 is fitted with the fitting portion 97 in such a manner that the cover 87 is fixed to the female terminal 86.

Accordingly, according to the second embodiment, a function effect similar to the first embodiment can be obtained. Furthermore, the reinforcement plate 88 overlapped on the substrate 21 is disposed, whereby the strength relative to the load applied in the width direction of the male terminal 85 can be enhanced. Furthermore, an unstability of the connector for the heavy current substrate 83 can be prevented.

Furthermore, the power source wire is connected to the female terminal 86 via the sleep terminal 91 to be connected to the terminal of the power source wire and the connecting portion 93 to be locked with the sleep terminal 91, whereby the power source wire can be easily connected to the female terminal 86.

Furthermore, the elastic side walls 92 and 94 of the female terminal 86 and the cover 87 are relatively shorter formed, whereby the female terminal 86 can be easily inserted into and be detached from the cover 87.

As described above, according to the present invention, both the side walls of the male terminal which is directly attached to the substrate are held between both the elastic side walls of the female terminal to be connected to the power source wire, whereby the power source wire can be easily connected to the substrate. Furthermore, an outer surface of the side wall of the male terminal is in a surficial contact with an inner surface of the elastic side wall of the female terminal, so that a contact area of both the terminals can be sufficiently ensured. As a result, it is possible to provide the connector for the heavy current substrate which can sufficiently tolerate the heavy current from the power source wire.

The female terminal is held by an insulating cover which is integrally curving formed by a pair of elastic side walls and the base wall, whereby the safety of the terminals can be ensured. Furthermore, the holding force of the female terminal for holding the male terminal is increased. Even if the foreign body is intervened between the terminals, the female terminal is always in contact with the male terminal. As a result, it is possible to provide the connector for the heavy current substrate which can maintain the stable connecting state of the terminals.

The reinforcement plate protruded parallel to the substrate and overlapped on the substrate is protruded on the side wall of the male terminal, whereby it is possible to provide the connector for the heavy current substrate in which the strength relative to the load applied in the width direction of the male terminal can be enhanced.

The detachment stopping protrusions are protruded on each side wall of the male terminal. The detachment stoppers to be locked with the detachment stopping protrusions are formed on each elastic side wall of the female terminal. The detachment stopping holes to be locked with the detachment stoppers are bored through each elastic side wall of the cover. Accordingly, when the cover is fitted with the female terminal, the positioning can be carried out. Furthermore, the detachment stopping holes bored through each elastic side wall of the female terminal and the cover are locked with one another, so that it is possible to prevent the female terminal and the cover from detaching. As a result, it is possible to provide the connector for the heavy current substrate in which the female terminal and the cover can be easily mounted and the stable connecting state can be maintained.

The female terminal is integrally formed by using the stainless, whereby it is possible to provide the connector for the heavy current substrate which can hold the male terminal at an appropriate contact pressure.

The connecting portion is inserted into the hollow portion of the cylindrical sleep terminal connected to the terminal of the power source wire so as to be connected to the power source wire, whereby the terminal of the power source wire can be easily connected to the female terminal. Accordingly, it is possible to provide the connector for the heavy current substrate in which a workability is enhanced.

It should be understood that many modifications and adaptations of the invention will become apparent to those skilled in the art and it is intended to encompass such obvious modifications and changes in the scope of the claims appended hereto.

What is claimed is:

1. A connector for a heavy current substrate in which a power source wire for passing the heavy current is connected to a substrate, comprising:

a male terminal which is flexibly formed by a pair of side walls to be directly attached to said substrate and a base wall, so that the section thereof is generally U-shaped; and a female terminal which is flexibly formed so as to be integrated with a pair of elastic side walls for holding said male terminal therebetween and a base wall in which a connecting portion to be connected to said power source wire is extended.

2. A connector for a heavy current substrate according to claim 1, further comprising:

an insulating cover which is flexibly formed so as to be integrated with a pair of elastic side walls for holding said female terminal therebetween and a base wall.

3. A connector for a heavy current substrate according to claim 1, wherein said male terminal has a reinforcement plate protruded parallel to said substrate and overlapped on said substrate at the side wall thereof.

4. A connector for a heavy current substrate according to claim 2, wherein said male terminal has a reinforcement plate protruded parallel to said substrate and overlapped on said substrate at the side wall thereof.

5. A connector for a heavy current substrate according to claim 2, wherein detachment stopping protrusions are protruded on each side wall of said male terminal; detachment stoppers to be locked with said detachment stopping protrusions are formed on each elastic side wall of said female terminal; and detachment stopping holes to be locked with said detachment stoppers are bored through each elastic side wall of said cover.

6. A connector for a heavy current substrate according to claim 4, wherein detachment stopping protrusions are protruded on each side wall of said male terminal; detachment stoppers to be locked with said detachment stopping protrusions are formed on each elastic side wall of said female terminal; and detachment stopping holes to be locked with said detachment stoppers are bored through each elastic side wall of said cover.

7. A connector for a heavy current substrate according to claim 1, wherein said female terminal is integrally formed of stainless steel.

8. A connector for a heavy current substrate according to claim 2, wherein said female terminal is integrally formed of stainless steel.

9. A connector for a heavy current substrate according to claim 1, wherein said connecting portion is inserted into and fitted with a hollow hole of a cylindrical sleep terminal connected to the terminal of said power source wire, so that said female terminal is connected to said power source wire.

10. A connector for a heavy current substrate according to claim 2, wherein said connecting portion is inserted into and fitted with a hollow hole of a cylindrical sleep terminal connected to the terminal of said power source wire, so that said female terminal is connected to said power source wire.

* * * * *